US005987939A

United States Patent [19]

Pitisettakarn

[11] Patent Number: 5,987,939

[45] Date of Patent: Nov. 23, 1999

[54] PADLOCK FOR USE WITH STEEL GRILLES

[75] Inventor: Thanyaluk Pitisettakarn, Bangkok, Thailand

[73] Assignee: Solex International (Thailand) Co., Ltd., Bangkok, Thailand

[21] Appl. No.: 09/168,127

[22] Filed: Oct. 7, 1998

[51] Int. Cl.[6] ..... E05B 67/36

[52] U.S. Cl. ..... 70/33; 70/34; 70/38 R

[58] Field of Search ..... 70/31–35, 38 R, 70/DIG. 60

[56] References Cited

U.S. PATENT DOCUMENTS

| | | | |
|---|---|---|---|
| 2,104,981 | 1/1938 | Falk | 70/33 |
| 2,656,704 | 10/1953 | Mancuso | 70/33 X |
| 3,581,530 | 6/1971 | Raspadori | 70/38 R |
| 5,517,837 | 5/1996 | Wang | 70/33 X |

FOREIGN PATENT DOCUMENTS

| | | | |
|---|---|---|---|
| 429320 | 5/1926 | Germany | 70/33 |
| 412692 | 2/1946 | Italy | 70/33 |
| 417571 | 1/1947 | Italy | 70/33 |
| 426892 | 11/1947 | Italy | 70/33 |
| 435219 | 5/1948 | Italy | 70/33 |

*Primary Examiner*—Lloyd A. Gall
*Attorney, Agent, or Firm*—Brinks Hofer Gilson & Lione

[57] ABSTRACT

A lock includes a locking bolt (21) and a lock body (32, 33). The lock body (32, 33) has a locking space (43) and aligned bores (37, 38) provided on either side of the locking space (43). The aligned bores (37, 38) received the locking bolt (21). A latch member (14) is provided within the lock body (32, 33) to release the locking bolt (21). A transverse bolt member (10) engages with the latch member (14) and thereby controls operation of the latch member (14). The transverse bolt member (10) is also provide within the lock body (32, 33). User operable locking cylinders (6) are operable on the transverse bolt member (10) to move the transverse bolt member (10) axially. The engagement between the latch member (14) and the transverse bolt member (10) is by way of respective engagement surfaces (15, 12*a*). One of the engagement surfaces is an inclined surface (12*a*). The second of the engagement surfaces (15) is slidable along the inclined engagement surface (12*a*) on axial movement of one of the members (10, 14) to bring about axial movement of the other member (10, 14). One of the members (10) extends through a through gap (16) provided in other member (14) from one side of that other member (14) of the opposite side.

16 Claims, 6 Drawing Sheets

PADLOCK FOR USE WITH STEEL GRILLES

BACKGROUND OF THE INVENTION

The present invention relates to a lock. In particular, although not exclusively, the invention relates to a double-core type padlock for use with steel grilles. However, it will be appreciated, that the invention is not limited in its use with steel grilles and may have many and varied applications.

Taiwan Utility Model Application No. 84202129 is illustrated in FIG. 1 (prior art). The double-core horizontal lock includes a main body 10 and a lock block defining a locking space 16 therebetween. The main body 10 and the lock block have aligned bolt holes 13 extending therethrough. In the locked configuration illustrated in FIG. 2, a lock bolt 70 extends through the bolt holes 13. The lock bolt 70 has two spaced peripheral grooves 71, 72. In the locked position illustrated in FIG. 2, a latch tongue 21 of a latch member 20 engages within the adjacent groove 72. The latch member 20 is an elongate member slidable axially and biased towards the locking position by spring 24. The locking member 20 includes a side notch 22. Operable within the side notch is one end of a mother and daughter pin arrangement 40, 42. The conical end face of the mother pin 40 engages with a correspondingly inclined surface formed in the side notch 22 of the latch member 20. In the locked configuration illustrated in FIG. 2, the spring 24 urges the latch member 20 such that the latch tongue 21 will be received in the groove 72. However, during the unlocking step as the key is turned as illustrated in FIG. 1, the mother pin 40 will be pushed upwardly and the inclined mating faces will move relative to each other so as to push the latch member 20 against the bias of the spring 24. This pulls back the latch tongue 21 from the groove thereby releasing the lock bolt 70.

It can be seen from FIGS. 1 and 2 that the mother pin 40 only engages with the side of the latch member 20. There is only a small contact surface between the two members and so if the components are not machined with fine tolerances, the engagement surfaces might accidentally disengage. Or alternatively, jamming might occur. The arrangement therefore does not lend itself to heavy duty applications.

SUMMARY OF THE INVENTION

It is therefore an object of the present invention to provide a lock which overcomes or ameliorates at least some of the above mentioned disadvantages.

In accordance with an aspect of the present invention there is provided a lock including: a locking bolt; a lock body having a locking space and aligned bores provided on either side of the locking space for receiving the locking bolt. There is also provided a latch member to release the locking bolt, the latch member having a central axis within the lock body. Also provided is a transverse bolt member extending transversely to the latch member within the lock body, the transverse bolt member having a central axis and engages with the latch member to control operation of the latch member. A user operable locking means operable on the transverse bolt member to move the transverse bolt member axially. The engagement between the latch member and the transverse bolt member being by way of respective engagement surfaces, one of which is an inclined engagement surface, the second of which is slidable along the inclined engagement surface on axial movement of one of the members to bring about axial movement of the other member, wherein one of the members extends through a through gap provided in the other member, the through gap extending from one side of that other member to the opposite side.

This invention also broadly comprises the parts, elements and features referred to or indicated in the specification of the application, individually or collectively, and or all combinations of any two or more of said parts, elements or features, and where specific integers are mentioned herein which have known equivalents in the art to which this invention relates, such known equivalents are deemed to be incorporated herein as if individually set forth.

The invention consists in the foregoing and also envisages constructions of which the following gives examples.

BRIEF DESCRIPTION OF THE DRAWINGS

As illustrated in FIG. 3, the padlock comprises a two part lock body including a main portion 32 and an arm portion 33. The main portion 32 is of uneven U-shaped configuration. The arm portion 33 attaches to one end of a lower arm portion of the main portion 32. The main portion 32 and the arm portion 33 have complementary engagement surfaces to facilitate secure attachment of the arm portion 33 to the main portion 32. The attachment is by means of a pair of screws 41 insertable through respective holes 39 provided in the arm portion 33. The screws 41 engage in respective holes 40 provided in the main portion 32. The holes 39 in the arm portion 33 can be covered by respective caps 42 as illustrated in FIG. 3. The assembled lock body defines a central locking space 43.

Figure 1:
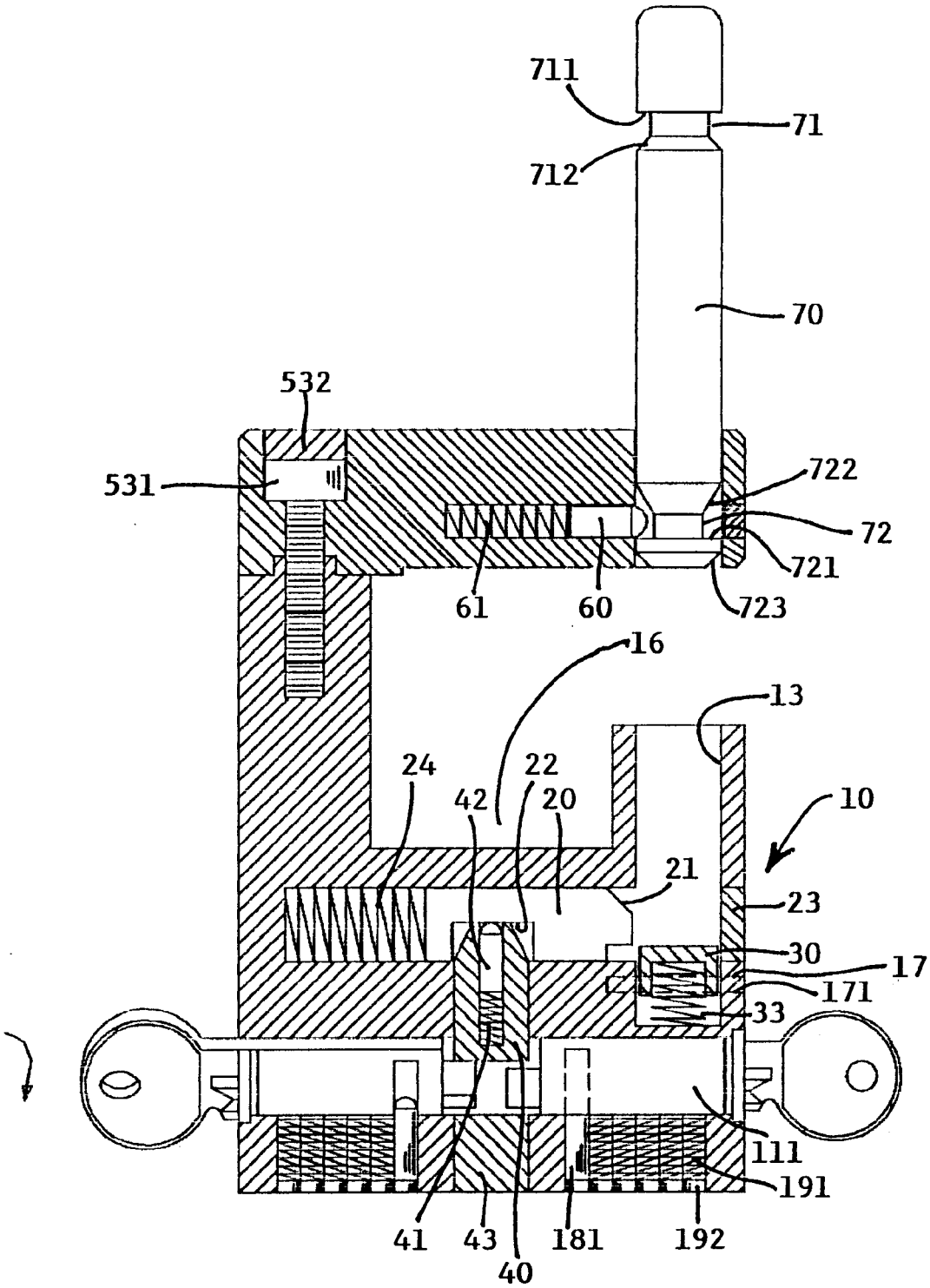
Fig. 1 (PRIOR ART)
FIG. 1 is a cross section view of a double-core horizontal PRIOR ART lock, the unlocked position.

The end of the arm portion 33 opposite to the end attached to the main portion 32 has a through bore 38 aligned with a blind bore 37 provided on the main portion 32. A locking bolt 21 is insertable through the aligned bores 38, 37 to extend across the locking space 43 in the manner illustrated in FIG. 4. A push spring 20 is received in the end of the blind bore 37 to bias the locking bolt 21 in the direction out of the bore 37.

A positioning bore 35 (FIG. 3) is machined through the main portion 32 and extends perpendicularly to the blind bore 37. The positioning bore 35 is also a blind bore. Inserted into the positioning bore 35 are a latch spring 13 and a latch member 14. The latch spring 13 biases the latch member 14 towards the locking bolt 21 as illustrated in FIG. 4. The latch member 14 has an elongate cylindrical latch body 18 having a central longitudinal axis. A latch tongue 17 is located at one end of the latch body 18. The latch tongue 17 has a diametrically extending latch surface 17*a* (see FIG. 5) to engage with the locking bolt 21, the operation of which will be described in due course. The other end of the latch body 18 has a diametrically extending gap 16 (see FIG. 3) in the form of a diametrically extending channel open at the other end of the latch body 18 facing the latch spring 13. The channel 16 extends perpendicularly to the latch surface 17*a* provided on the latch tongue 17. A hook pin 15 extends across the diametrically extending channel 16.

Figure 4:
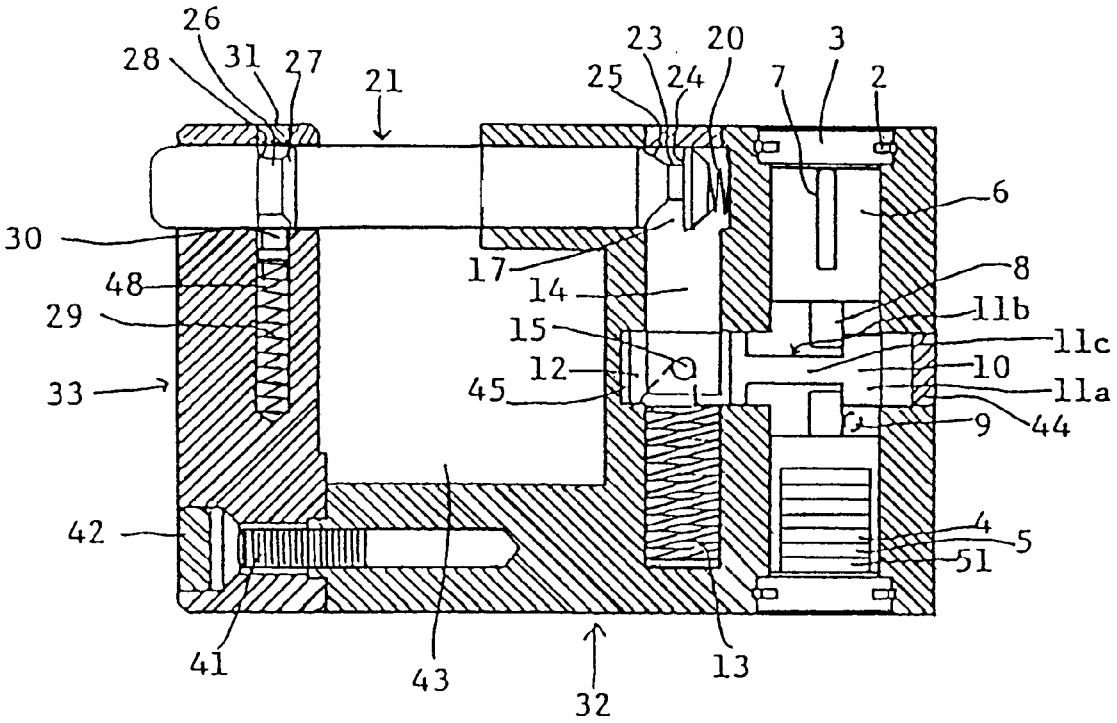
FIG. 4 is a side cross-sectional view of the padlock of FIG. 3 shown in the locked configuration.
Figure 5:
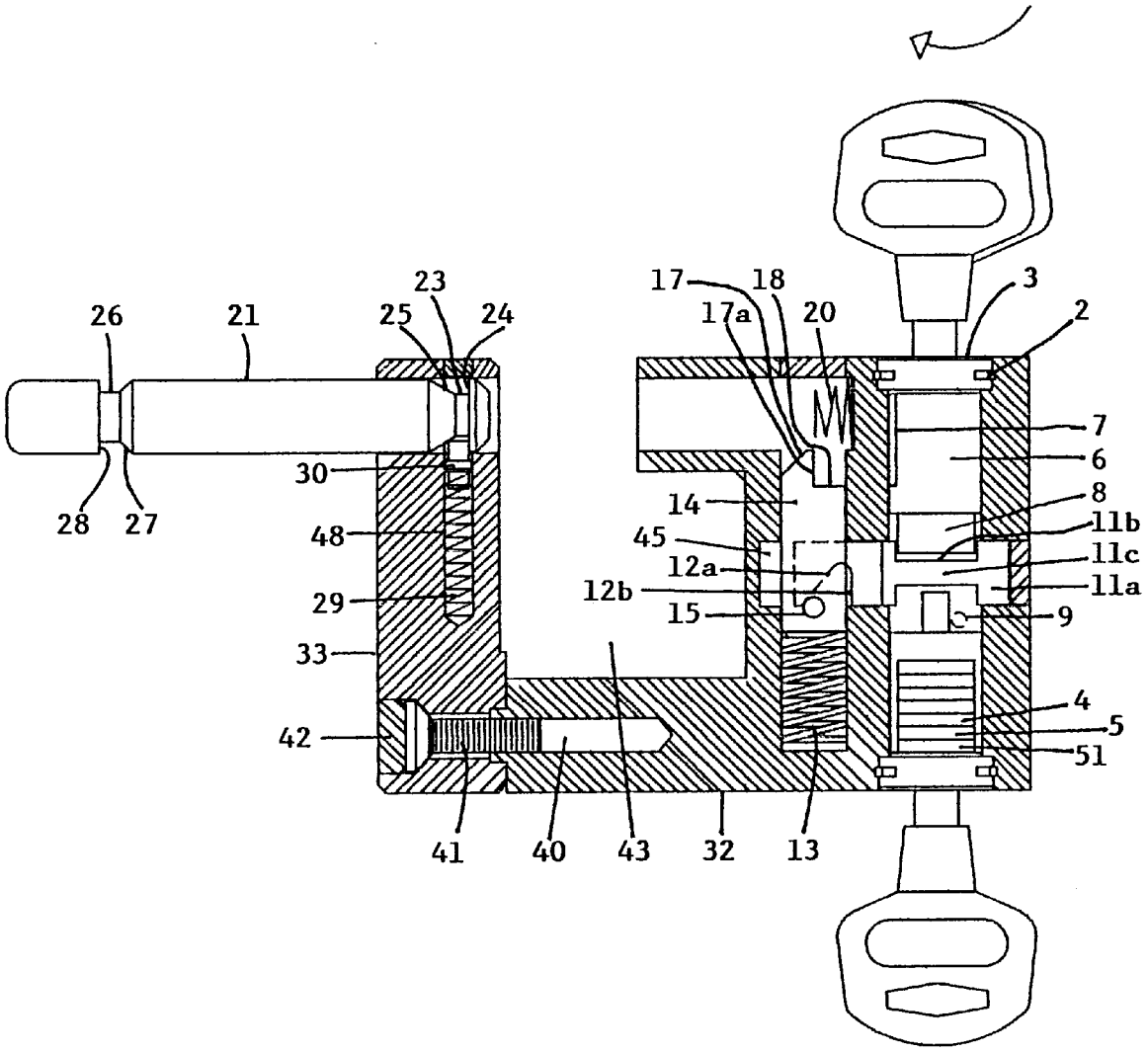
FIG. 5 is a side cross-sectional view as in FIG. 4 except shown in the unlocked configuration.

Extending parallel to the positioning bore 35, is an open ended cylinder bore 36. The positioning bore 35 and the cylinder bore 36 are interconnected by a transverse bore 45. The transverse bore 45 extends cross both the cylinder bore 36 and the positioning bore 35, extending slightly beyond the positioning bore 35 to a blind end as illustrated in FIG. 5. The other end of the bore 45 is closed by an end cap 44. Received within the transverse bore 45 is a transverse hook bolt 10. The transverse hook bolt 10 includes a hook portion 12 disposed at one end of the transverse hook bolt 10 to engage with the hook pin 15. The transverse hook bolt 10 is machined from an elongate cylindrical rod and has a central longitudinal axis. The hook portion 12 has flat sides so as to be insertable through the diametrically extending channel 16 provided in the latch body 18. The open side of the hook portion 12 includes an inclined surface 12*a* and a stop surface 12*b* which is parallel to the central longitudinal axis of the latch body 18. The hook pin 15 is received in the open side of the hook portion 12 as illustrated in FIG. 4.

Spaced from the hook portion 12 are lock rotating recesses 11 provided on opposite sides of the transverse hook bolt 10. The lock rotating recesses 11 are each defined by a base wall 11*b* and a contact wall 11*a* and a wall opposite to the contact wall. The base walls 11*b* defined a generally planar bridging portion 11*c* therebetween. The bridging portion 11*c* extends perpendicularly to the hook portion 12.

Figure 2:
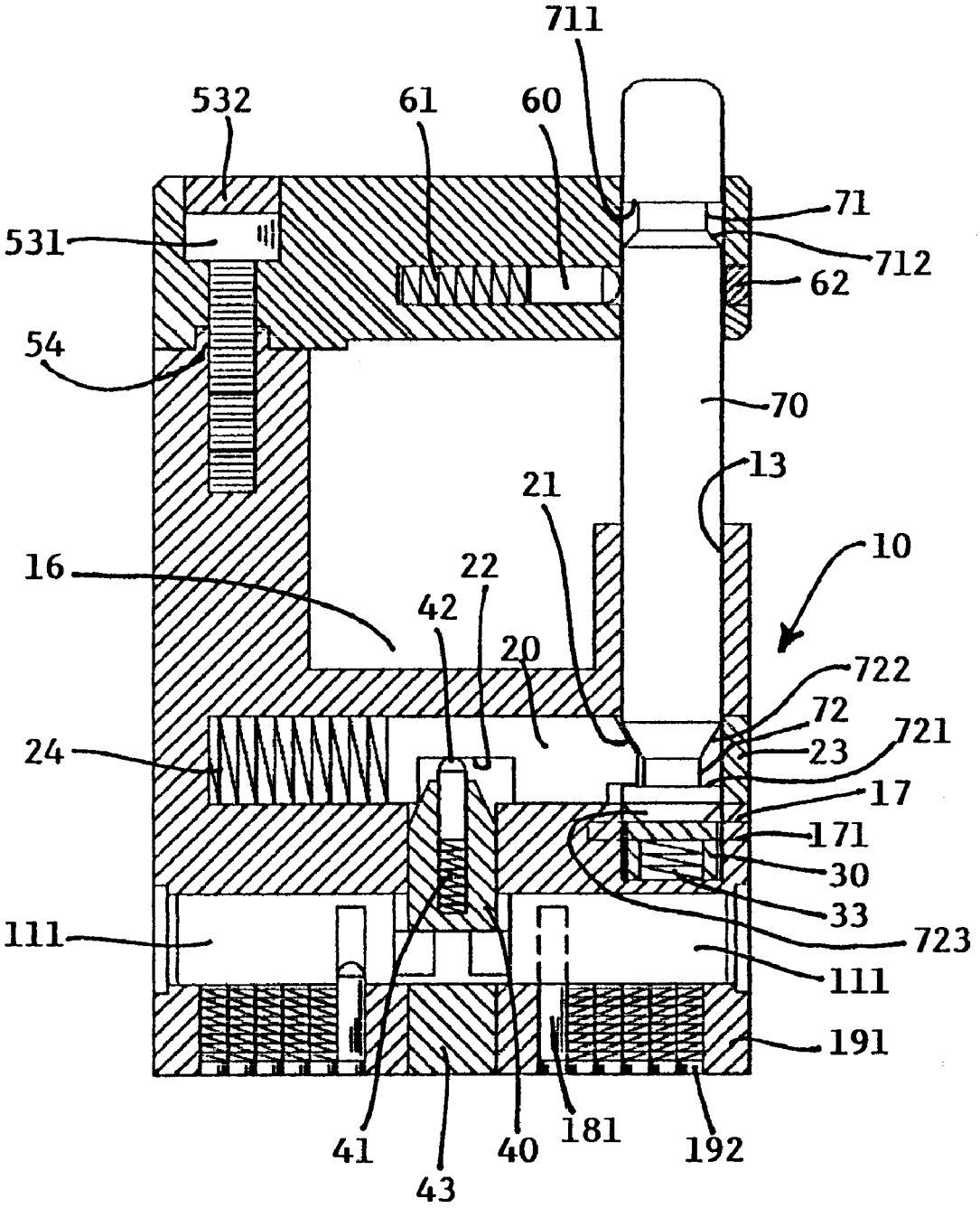
Fig. 2 (PRIOR ART)
FIG. 2 is a cross section view of a double-core horizontal PRIOR ART lock, in the locked position.

Receiving in the cylinder bore 36 are a pair of user operable locking cylinders 6. Received within each locking cylinder 6 are alternatively arranged code disks 4 and code spacers 5. Such a lock has up to millions of code combinations and is therefore more durable and more difficult to pick than the pin tumbler arrangement illustrated in the prior art shown in FIGS. 1 and 2. The cylinders 6 each have a groove 47 extending along the peripheral surface, the groove 47 being parallel to the central longitudinal axis of the cylinder 6. A locking pin 7 located within the groove 47 in assembled configuration.

Each of the cylinders 6 are retained within their respective ends of the cylinder bore 36 by an annular lock plug 3. The lock plug 3 has a peripheral annular groove 49. A C-clip of hardened steel 2 locates within the peripheral groove 49 and engages within a corresponding groove 50 provided adjacent the opening of the cylinder bore 36 to retain the lock plug 3 in position. Such an arrangement is different to extract and hence, is superior to the arrangement illustrated in the prior art. Additionally, the first code disk 4 which is labeled 51 is also constructed of hardened steel. This reduces the possibility of drilling through the code disks 4 of the locking cylinders 6. The insertion of the correct key 1 into either of the locking cylinder 6 and through the code disks 4, enables that locking cylinder 6 to turn. The opposite ends of the locking cylinders 6 to the open ends of the cylinder bore 36 comprise turning tabs 8. Theses turning tabs 8 each comprise diametrically extending projections which lie within respective lock rotating recesses 11. The turning tabs 8 engage with respective contact walls 11*a* to move the transverse hook bolt 10 towards the right as illustrated in FIGS. 4 and 5.

The main portion 32 of the lock body also has holes 46 extending through to the cylinder bore from either side. The holes 46 receive pins 9 which limit the rotational movement of the turning tabs 8 beyond the locked position. The rotational movement of the turning tabs 8 is also limited beyond the unlocked position by one side of each turning tab 8 abutting against the wall of the lock rotating recess 11 opposite the contact wall 11*a*.

The arm portion 33 also includes a catch bore 34 of small diameter. The catch bore 34 extends in the general longitudinal direction of the arm portion 33 and transversely to the through bore 38 downwards to form a blind bore 48 in the arm portion 33 (FIGS. 4, 5). The blind bore 48 receives a catch spring 29 and catch pin 30 by inserting them through the catch bore 34. The catch spring 29 biases the catch pin 30 in the direction out of the blind bore 48. Once the main components of the padlock are assembled, the cap 31 is inserted into the open end of the catch bore 34. The cap 31 may be of the same metallic material as the lock body and may be welded into position once the main components of the padlock have been assembled. Likewise, any of the other end caps inserted into the open end of respective bores may be welded into position.

Figure 3:
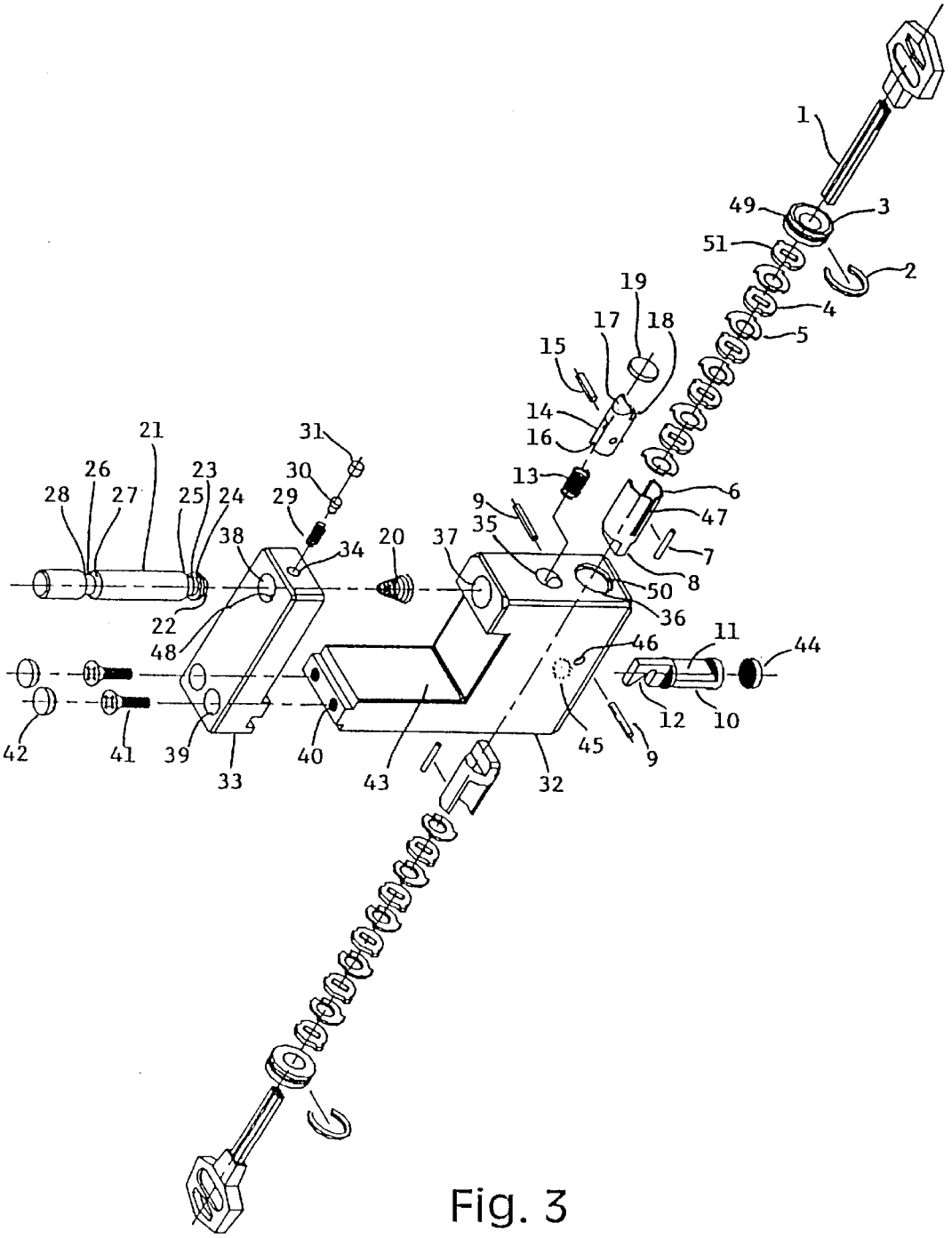
FIG. 3 is an exploded perspective view of padlock constructed in accordance with a preferred embodiment of the present invention.

As can be best seen in FIG. 3, the locking bolt 21 includes two spaced peripheral grooves 23, 26. Each peripheral groove 23, 26 is defined by a stop surface 24, 28 at the side closest to the outer end of the locking bolt 21. The inner sides of each peripheral groove 23, 26 are defined by an inclined surface 25, 27. It will be understood from FIG. 4 that the catch pin 30 engages in the peripheral groove 26 when the locking bolt 21 is in the locked configuration. The catch pin 30 which is biased by catch spring 29 into the peripheral groove 26 engages against stop surface 28 to prevent further insertion of the locking bolt 21. When the locking bolt 21 is in the unlocked position illustrated in FIG. 5, the catch pin 30 engages within peripheral groove 23 and against stop surface 24 preventing further withdrawal of the locking bolt 21. Similarly, the latch tongue 17 engages in the peripheral groove 23 and against stop surface 24 to prevent withdrawal of the locking bolt 21 in the locked configuration of the padlock as illustrated in FIG. 4.

Figure 6:
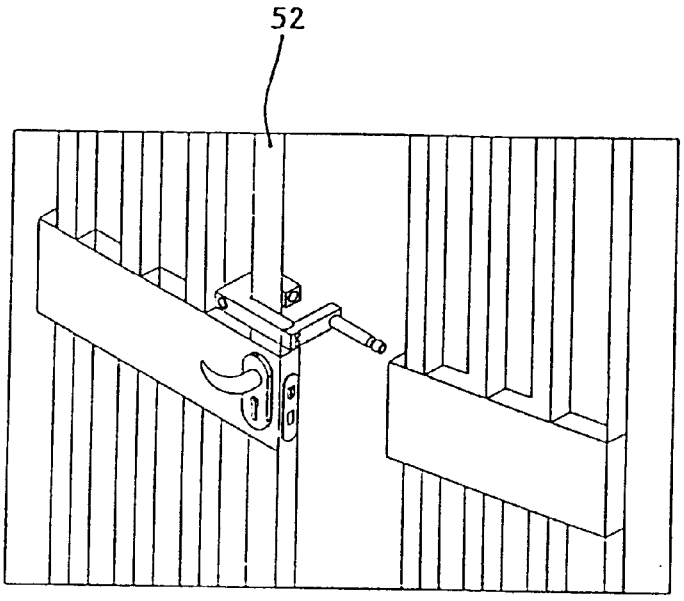
FIG. 6 is a perspective view of one intended use of the padlock illustrated in FIG. 3.
Figure 7:
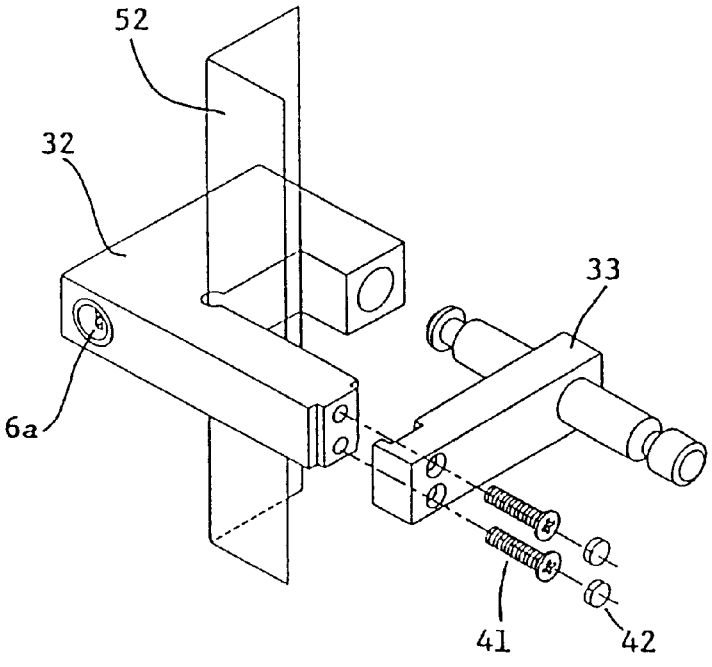
FIG. 7 is a perspective view illustrating the installation of the padlock in its intended application shown in FIG. 6.

FIGS. 6 and 7 illustrate an intended application of the padlock. As shown in FIG. 6, the padlock may be used to lock a gate in a metal grille wall, fence or enclosure. The padlock is located around the outermost bar 52 of the gate. FIG. 7 illustrates that the main portion 32 and the arm portion 33 may be assembled around the end bar 52 to position the padlock. Since the padlock has two lock cylinders provided on opposite sides, the padlock can be operated by inserting a key through the keyhole 6*a* (only one of which is shown), on either side of the gate.

In operation, the user inserts the key 1 into one of the user operable locking cylinders 6. Insertion of the key enables turning of the cylinder 6 and the turning tab 8. In the locked position, one side face of the turning tab 8 abuts against the contact wall 11*a*. Turning of the turning tab 8 will thereby push the contact wall 11*a* towards the right until it reaches the position shown in FIG. 5. As a consequence of the right hand movement of the transverse hook bolt 10, the inclined surface 12*a* will be moved rightward. Since the hook pin 15 is held by latch spring 13 against the inclined surface 12*a*, rightward movement of the transverse hook bolt 10 causes the hook pin 15 to move towards the blind end of the positioning bore 35. Consequently, the latch tongue 17 is pulled out of engagement with the peripheral groove 23 thereby releasing the lock bolt 21. The lock bolt 21 is pushed open under the influence of spring 20.

I claim:

1. A lock including:

a locking bolt;

a lock body having a locking space and aligned bores provided on either side of the locking space fore receiving the locking bolt;

a latch member to release the locking bolt, the latch member having a central axis and provided within the lock body;

a transverse bolt member extending transversely to the latch member within the lock body, the transverse bolt member having a central axis and engaging with the latch member to control operation of the latch member;

a user operable locking means operable on the transverse bolt member to move the transverse bolt member axially;

the engagement between the latch member and the transverse bolt member being by way of respective engagement surfaces, one of which is an inclined engagement surface, the second of which is slidable along the inclined engagement surface on axial movement of one of the members to bring about axial movement of the other member, wherein one of the members extends through a through gap provided in the other member, the through gap extending from one side of that other member to the opposite side.

2. The lock as claimed in claim 1 wherein the second engagement surface is disposed within the through gap.

3. The lock as claimed in claim 1 or 2 wherein the through gap is a slot.

4. The lock as claimed in claim 1 or 2 wherein the through gap is a channel located at one end of the latch member of which the other end is engageable with the locking bolt.

5. The lock as claimed in claim 4 wherein the channel extends across the latch member through the central axis, the channel extending perpendicularly to a latch surface of the latch member which is engageable with the locking bolt.

6. The lock as claimed in claims 1 or 2 wherein the second engagement surface is in the form of a pin extending transversely to the plane in which both members lie.

7. The lock as claimed in claims 1 or 2 wherein the inclined engagement surface forms part of a hook portion of the associated member.

8. The lock as claimed in claims 1 or 2 wherein the inclined engagement surface forms part of a hook portion of the associated member; and an open side of the hook portion includes the inclined engagement surface and a stop surface extending generally parallel to the central axis of the other member on which the second engagement surface is provided.

9. The lock as claimed in claims 1 or 2 wherein the inclined engagement surface forms part of a hook portion of the associated member; and the hook portion is provided on the transverse bolt member, there being spaced from the hook portion, a side recess which is defined at one end thereof by a contact wall against which a rotating end portion of the user operable locking means operates to move the transverse bolt member axially.

10. The lock as claimed in claims 1 or 2 wherein the inclined engagement surface forms part of a hook portion of the associated member;

the hook portion is provided on the transverse bolt member, there being spaced from the hook portion, a side recess which is defined at one end thereof by a contact wall against which a rotating end portion of the user operable locking means operates to move the transverse bolt member axially; and there being two of said side recesses provided on opposite sides of the transverse bolt member, each recess being operable with respective user operable locking means.

11. The lock as claimed in claims 1 or 2 wherein the inclined engagement surface forms part of a hook portion of the associated member;

the hook portion is provided on the transverse bolt member, there being spaced from the hook portion a side recess which is defined at one end thereof by a contact wall against which a rotating end portion of the user operable locking means operates to move the transverse bolt member axially;

there being two of said side recesses provided on opposite sides of the transverse bolt member, each recess being cooperative with respective user operable locking means; and said hook portion being generally planar and wherein each of said recesses are defined by base walls, there being a generally planar bridging portion defined by the two base walls, the bridging portion extending perpendicularly to the hook portion.

12. The lock as claimed in claims 1 or 2 wherein the user operable locking means is received in a bore in the lock body, the opening of which is closed by a plug member having a circumferential groove in which is received a hardened steel circlip.

13. A lock including:

a locking bolt;

a lock body having a locking space and aligned bores provided on either side of the locking space for receiving the locking bolt;

a latch member to release the locking bolt, the latch member having a central axis and provided within the lock body;

a transverse bolt member extending transversely to the latch member within the lock body, the transverse bolt member having a central axis and engaging with the latch member to control operation of the latch member;

a user operable locking means operable on the transverse bolt member to move the transverse bolt member axially;

the engagement between the latch member and the transverse bolt member being by way of respective engagement surfaces, one of which is an inclined engagement surface, the second of which is slidable along the inclined engagement surface on axial movement of one of the members to bring about axial movement of the other member, wherein one of the members extends through a through gap provided in the other member, the through gap extending from one side of that other member to the opposite side;

said lock having a rotation limit pin associated with the user operable locking means to limit rotation of the user operable locking means, the rotation limit pin being inserted through a respective side of the body.

14. A lock including:

a locking bolt;

a lock body having a locking space and aligned bores provided on either side of the locking space fore receiving the locking bolt;

a latch member to release the locking bolt, the latch member having a central axis and provided within the lock body;

a transverse bolt member extending transversely to the latch member within the lock body, the transverse bolt member having a central axis and engaging with the latch member to control operation of the latch member;

a user operable locking means operable on the transverse bolt member to move the transverse bolt member axially;

the engagement between the latch member and the transverse bolt member being by way of respective engagement surfaces, one of which is an inclined engagement surface, the second of which is slidable along the inclined engagement surface on axial movement of one of the members to bring about axial movement of the other member, wherein one of the members extends through a through gap provided in the other member, the through gap extending from one side of that other member to the opposite side;

said lock having a user operable locking means assembled by alternately arranged code disks and code spacers.

15. The lock as claimed in claim 14 wherein a first code disk located closest to the exterior of the lock body is comprised of hardened steel.

16. The lock as claimed in claims 13 or 14 wherein the second engagement surface is disposed within the through gap.

* * * * *

UNITED STATES PATENT AND TRADEMARK OFFICE

CERTIFICATE OF CORRECTION

PATENT NO. : 5,987,939

DATED : November 23, 1999

INVENTOR(S) : Thanyaluk Pitisettakarn

It is certified that error appears in the above-identified patent and that said Letters Patent is hereby corrected as shown below:

On the title page, item [57], line 21, after "in" insert --the--.

Column 2, line 14, after "lock" insert -- in --.

Column 3, line 38, change "located" to -- locates --.

Claim 1, Col. 4, line 63, change "fore" to -- for --.

Claim 14, Col. 6, line 55, change "fore" to -- for --.

Signed and Sealed this

Third Day of October, 2000

*Attest:*

Q. TODD DICKINSON

*Attesting Officer*

*Director of Patents and Trademarks*